United States Patent [19]

Hasircoglu et al.

[11] Patent Number: 5,035,634

[45] Date of Patent: Jul. 30, 1991

[54] CONNECTOR INJECT AND EJECT CAM LEVER ASSEMBLY

[75] Inventors: Alexander W. Hasircoglu, Lancaster; David T. Humphrey, Mechanicsburg, both of Pa.

[73] Assignee: E. I. Du Pont de Nemours and Company, Wilmington, Del.

[21] Appl. No.: 606,374

[22] Filed: Oct. 31, 1990

Related U.S. Application Data

[63] Continuation of Ser. No. 545,046, Jun. 28, 1990, abandoned.

[51] Int. Cl.[5] ..... H01R 13/62

[52] U.S. Cl. ..... 439/157

[58] Field of Search ..... 439/152–160

[56] References Cited

U.S. PATENT DOCUMENTS

| | | | |
|---|---|---|---|
| 2,987,693 | 6/1961 | Wamsley | 439/157 |
| 3,059,206 | 10/1962 | Williams | 439/157 |
| 4,083,616 | 4/1978 | McNiece et al. | 339/45 M |
| 4,152,038 | 5/1979 | Inouye et al. | 339/75 M |
| 4,241,966 | 12/1980 | Gomez | 439/157 |
| 4,537,454 | 8/1985 | Douty et al. | 339/45 M |
| 4,640,565 | 2/1987 | Hasircoglu | 339/45 M |
| 4,874,319 | 10/1989 | Hasircoglu | 439/108 |

*Primary Examiner*—Joseph H. McGlynn
*Attorney, Agent, or Firm*—John E. Griffiths

[57] ABSTRACT

The present invention relates to electrical connectors and, more particularly, to cam levers for injecting and ejecting a connector from another part.

17 Claims, 5 Drawing Sheets

CONNECTOR INJECT AND EJECT CAM LEVER ASSEMBLY

This application is a continuation of application Ser. No. 07/545046 filed June 28, 1990, now abandoned.

BACKGROUND OF THE INVENTION

1. Field of the Invention

This invention relates to electrical connectors and, more particularly, to cam levers for injecting and ejecting a connector from another part.

2. Description of Related Art

Electrical connectors for making large numbers of interconnections are used extensively in computers and other similar electronic apparatus. Although there is considerable variation in the known connector sizes, connectors for making 26 or more connections are very common. Each individual connection may be made by inserting a pin or male terminal in a socket or female terminal, or by joining two identical "hermaphroditic" terminals.

Connectors typically include two components: a housing, shroud or shell member and a plurality of pins, sockets, terminals or electrical contact elements. The term housing or shell is typically used to refer to a plastic or metal package for holding a plurality of male, female or hermaphroditic terminals which are connected to the package. The term shroud is used to refer to a plastic or metal package for enclosing or protecting the plurality of male, female or hermaphroditic terminals which are not connected to the package, but, for instance, to a printed circuit board.

A connector may be attached to the end of a multiple conductor cable. Alternatively, a first connector may mechanically and electrically interconnect a backpanel or mother printed circuit or wiring board with a second connector which is mechanically and electrically connected to a daughter printed circuit or wiring board. Since the daughter board or card is typically perpendicular to the mother board, a vertical edge card connector or a right angle connector may be used as the second connector. Many other applications are known to those skilled in the art.

A female connector is a connector typically with female terminals and is commonly referred to as a receptacle. A male connector is a connector typically with male terminals and is commonly referred to as a header.

Although the connector may provide a large number of connections, the spacing between the individual connections is typically relatively small (e.g., approximately 0.1 inches). The overall dimensions of many connector housing members and associated terminals are also relatively small. For example, mating faces of the housing member may measure approximately 0.25 inches by 1.5 inches in a connector for making 26 connections in two parallel rows on 0.1 inch centers.

Considerable force may be required to plug the receptacle into the header in the above-described connectors because of the large number of electrical connections being made simultaneously. For the same reason, considerable force may be required to unplug the receptacle from the header.

It is known to provide ejecting latches on a header for releasably extracting a receptacle from the header. The known latches cooperate with ejection surfaces on the receptacle for separating the receptacle from the header when the latches are deliberately released. This greatly facilitates unplugging the receptacle from the header and eliminates the need for possibly destructive pulling on the relatively small connector contact elements or the components (e.g., cables or printed circuit boards) to which the connector contact elements are attached. See, for instance, U.S. Pat. 4,640,565 and 4,874,319.

The ejecting latches described above are quite useful in ejecting the connectors apart. Some known ejecting latches further hold the connectors together once they are forced together. However, they do not facilitate plugging or inserting the connectors together.

It is therefore an object of this invention to provide injecting and ejecting latches for electrical connectors of the type described above.

It is another object of this invention to provide injecting and ejecting latches for electrical connectors which can be easily operated even where there are several closely spaced connectors.

SUMMARY OF THE INVENTION

The present invention is directed to an inject and eject cam lever assembly for providing a mechanical advantage while forcing a first connector into a mated position with a second connector, the assembly comprising:

- a first protrusion for extending from a first side of either the first connector or the second connector; and
- a first lever for pivotably mounting about a pivot on a first side of the connector without the protrusion, the lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from the mated position by positioning the first connector adjacent the second connector substantially before the force is applied, positioning the lever with the protrusion in the mouth end, applying a force on the grip in a first direction camming the protrusion against the inject cam surface until the connectors are in the mated position, and applying a force on the grip in a second direction camming the protrusion against the eject cam surface until the protrusion is substantially in the first position.

The present invention is further directed to an electrical connector assembly comprising:

- a first connector having a housing and a plurality of electrical contact elements;
- a second connector having a housing and a plurality of electrical contact elements, the second connector adapted to mate with the first connector when a force is exerted to push or pull the connectors together;
- a first protrusion extending from a first side of the housing of either the first connector or the second connector; and
- a first lever pivotably mounted about a pivot on a first side of the housing of the connector without the protrusion, the lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from a mated position by positioning the first connector adjacent the second connector substantially before the force is applied, positioning the lever with the protrusion in a first position in the mouth end, applying a force on the grip in a first direction camming the protrusion against the inject cam surface until the connectors are in the mated position, and applying a force on the grip in a second direction camming the protrusion against the eject cam surface until the protrusion is substantially in the first position.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
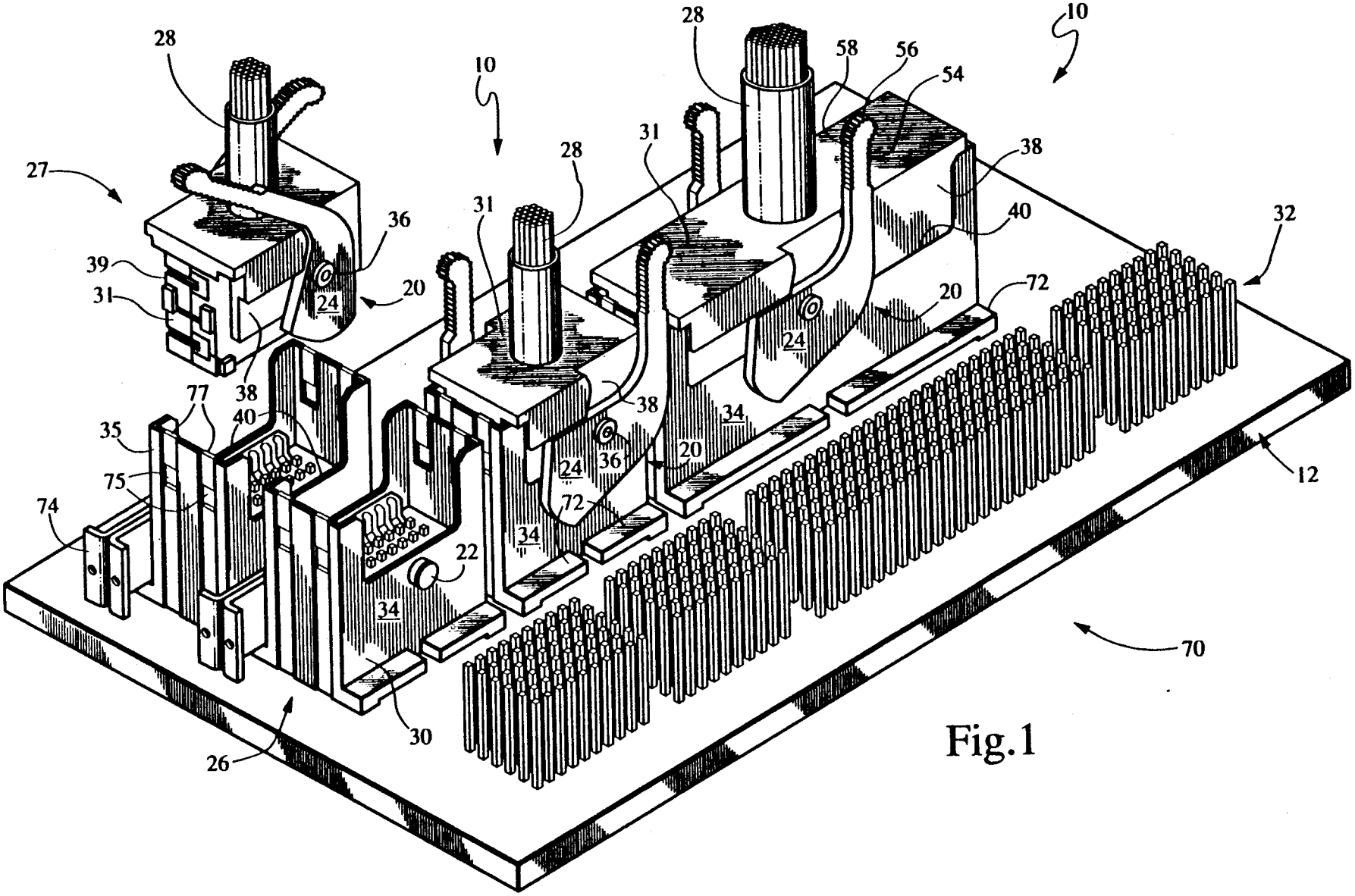
FIG. 1 is a perspective view of an electronic apparatus illustrating inject and eject cam lever assemblies on connector assemblies in accordance with the present invention.

Throughout the following detailed description, similar reference characters refer to similar elements in all figures of the drawings.

Referring to FIG. 1, several connector assemblies 10 made in accordance with the present invention are illustrated in combination with a printed circuit board 12. Each one of the connector assemblies 10 includes a first connector 26, a second connector 27 and at least one inject and eject (or injection and ejection) cam lever assembly 20 in accordance with the present invention. The cam lever assemblies 20 are illustrated on particular connector housings and in a particular printed circuit board apparatus 70, but can be used to facilitate inserting and/or unplugging virtually any two mateable connectors together and/or apart. Further, when the connectors are mated together, the inject and eject cam lever assemblies 20 secure, lock or latch the connectors together such that the connectors are prevented from being pulled apart without releasing the cam lever assemblies 20.

The inject and eject cam lever assemblies 20 comprise at least one protrusion or knob 22 and at least one lever 24 on a mateable pair of connectors 26, 27. Each connector 26, 27 of the pair may be attached or attachable to an end of a multiple conductor cable 28, a flat side of a printed circuit or wiring board 12, an edge of a printed circuit or wiring board 12 or any other part, regardless of the configuration of the other connector 26, 27 in the pair. Each connector 26, 27 may be a vertical or right angle connector, regardless of the configuration of the other connector in the pair. Either one of the connectors 26, 27 can be a female connector with the other being a male connector mateable with the female connector.

The mateable pair of connectors 26, 27 comprises a first connector 26 having a first housing 30 and a second connector 27 having a second housing 31. For the purposes of this disclosure, the term "housing" includes the structures typically referred to as connector housings, shells, shrouds, packaging and the like. Each housing 30, 31 may be secured to a plurality of male, female or hermaphroditic terminals 32. Alternatively, each housing 30, 31 may be for connection to a printed circuit board 12 and around a plurality of male, female or hermaphroditic terminals 32. However, the second housing 31 must be adapted to mate, or be mateable, with the first housing 30 when a force is exerted to push or pull the connectors 26, 27 with respect to each other.

The protrusion or knob 22 extends from a first side 34 of the housing 30, 31 of either the first connector 26 or the second connector 27. The lever 24 is pivotably mounted about a pivot 36 on a first side 38 of the housing 31 of the connector 27 without the protrusion 22. For illustration purposes, the Figures show the protrusion 22 on the first or lower housing 30, but it could have been illustrated on the second or higher housing 31. If the protrusion is on the second housing 31, then the lever is pivotably mounted on the first housing 30. Preferably, the pivot 36 is closer to a first mating surface end 40 of the first side 34 than a second end of the first side 34 distal to the first end 40 of the first side 34. Preferably, the lever 24 has a substantially dog leg shape to provide a visual and tactile indicator of whether the connectors 26 are latched together by the lever 24 and the protrusion 22. The dog leg shape of the lever 24 includes a knee, elbow or bend.

Figure 2:
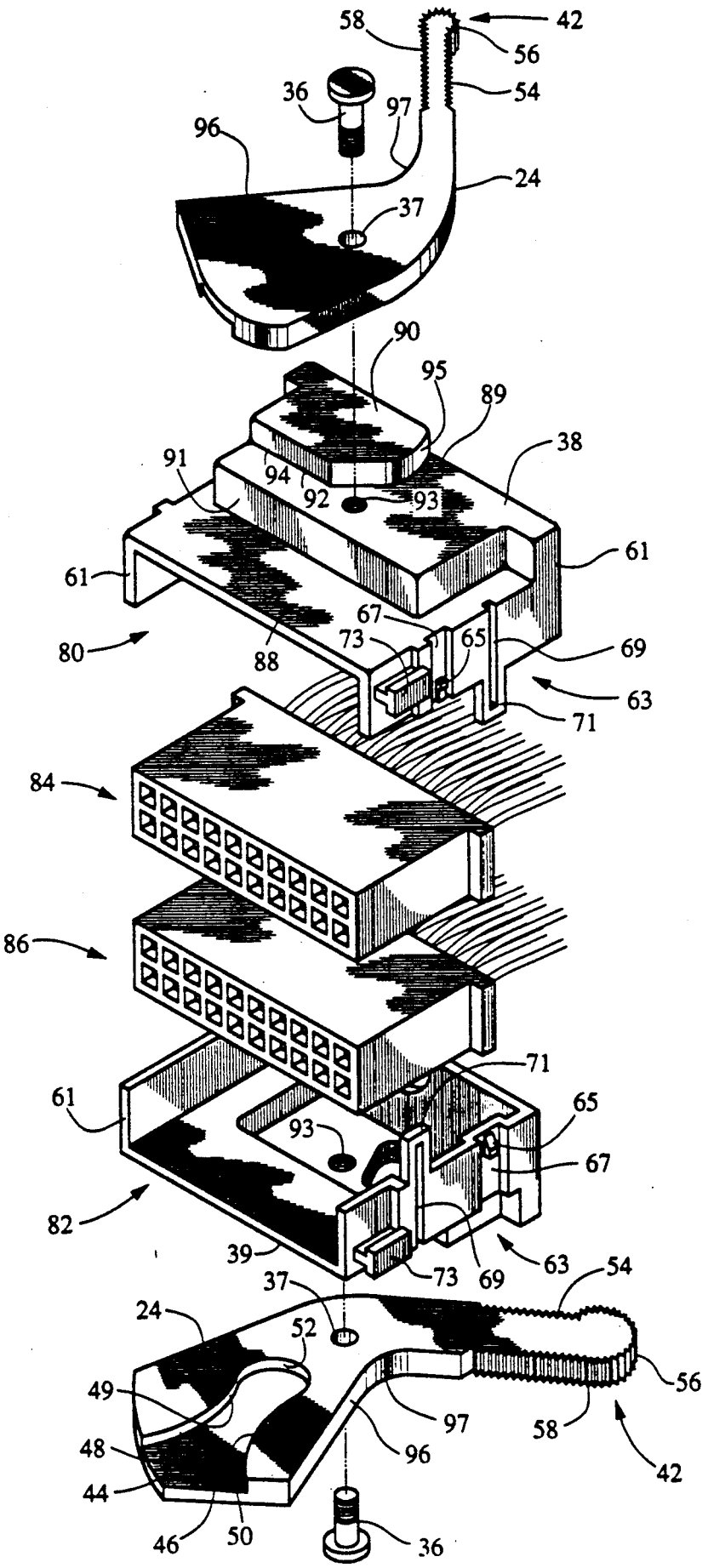
FIG. 2 is an exploded view illustrating parts of a first embodiment of a female connector including a pair of inject and eject cam levers in accordance with the present invention.

FIG. 2 is an exploded view illustrating parts of a first embodiment of the connector 31 in accordance with the present invention. The connector 31 is illustrated as a female connector or receptacle. In this embodiment, the connector 31 comprises at least one connector arrangement 84, 86, at least one housing portion 80, 82, and a pair of the inject and eject cam levers 24 pivotably mounted to the housing portions 80, 82 by pivots 36.

The connector arrangements 84, 86 can be any conventional connectors or connector assemblies. For instance, TLC connectors can be used as suitable connector arrangements 84, 86 in the present invention. TLC connectors are commercially available in assemblies having model/part number 83254-001 from E. I. du Pont de Nemours and Company with offices in Wilmington Delaware.

The housing portion 80, 82 can be any shape. For illustrative purposes, the housing portion is are depicted as two mateable clam shells. The shells 80, 82 can be insulative, such as plastic, or conductive, such as metal. The housing portion can be integral with the connector arrangement or arrangements 84, 86. Alternatively, as illustrated in FIG. 2, the shells 80, 82 can be separate parts detachable from each other and detachable from the connector arrangement or arrangements 84, 86. When the shells 80, 82 are so separable, the housing 31 comprises the first shell 80 and the second shell 82. The first side 38 and the second side 39 of the clam shells 80 and 82 have a first surface 88, a second surface 89 and a third surface 90. The first, second and third surfaces 88, 89, 90 may be parallel or generally parallel to one another. The first and second surfaces 88, 89 are separated by a first step 91. The second and third surfaces 89, 90 are separated by a second step 92. When the connector 31 is assembled, the first surface 88 on the shell 80 and the first surface 88 on the shell 82 are spaced a distance $D_1$ apart; the second surface 89 on the shell 80 and the second surface 89 on the shell 82 are spaced a distance $D_2$ apart; and the third surface 90 on the shell 80 and the third surface 90 on the shell 82 are spaced a distance $D_3$ apart. Preferably, $D_1$ is less than $D_2$; and $D_2$ is less than $D_3$. One of the pivots 36 can be mounted in a hole 93 in each of the second surfaces 89. The second step 92 includes a first surface portion 94 and a second surface portion 95. The first surface portion 94 contacts or stops a first edge portion 96 of the lever 24 when the lever is in its latched position. The second surface portion 97 contacts or stops a second edge portion 97 of the lever 24 when the lever 24 is in its unlatched position. The first surface portion 94 and the first edge portion 96 preferably have corresponding contours. For instance, as illustrated in FIG. 2, the first surface portion 94 and the first edge portion 96 can be flat or substantially flat. Similarly, the second surface portion 95 and the second edge portion 97 preferably have corresponding contours. For instance, as illustrated in FIG. 2, the second surface portion 95 and the second edge portion 97 can be curved. The distance $D_1$ is chosen such that the first surfaces 88 fit in the housing 34 of the mating connector 30. The distance $D_2$ is chosen such that the first steps 91 contact the top of the housing 34 of the mating connector 30 and, thus, prevent the second surfaces 89 from fitting into the housing 34. End sides 61 of the shells 80, 82 can have latching mechanisms 63 for detachably securing the shell 80 to the shell 82 securing the connector arrangement or arrangements 84, 86 within the shells 80, 82. The latching mechanisms 63 may comprise at least one ramped bump 65 positioned in a groove 67 in either the end sides 61 of the shell 80 or the end sides 61 of the shell 82. Then the latching mechanisms 63 could further include either a groove or a slot 69 beginning in tabs 71 in the other end sides 61 of the other shell. To connect the shells 80, 82 together, the tabs 71 are forced in the grooves or slots 69 until the ramped bumps 65 rest in the grooves or slots 69. To disconnect the shells 80, 82, the tabs 71 must be raised over the bumps 65. The ramps on the bumps 65 facilitate connection of the shells 80, 82, but the ramps do not facilitate disconnecting the shells 80, 82. The end sides 61 of the shells 80, 82 may also have break away keys 73 for inserting in corresponding slots 75 in a mating connector 26. See FIG. 1. Break away sections 77 in the mating connector 26 must be removed extending the slots 75 to permit one of the keys 73 to enter the slot 75. One or more of the keys 73 can be snapped or broken off the shells 80, 82 and one of more corresponding break away section 77 can be left on the mating connector 26 in order to ensure that only certain connectors 27 mate with other connectors 26 or that certain end sides 61 of connectors 26, 27 are always adjacent to one another when the connectors 26, 27 are mated.

Each one of the levers 24 has a grip or grip portion 42 and a groove, slot, recess or pocket 44 for receiving the protrusion 22. The groove or slot 44 has a mouth end 46, an inject cam surface 48, an eject cam surface 50 and a mated end 52. When the camming means 44 is a groove, slot or pocket, the groove, slot or pocket is in a side of the lever 24 adjacent the housing 30. When the protrusion 22 is positioned in or substantially in the mated end 52, the connectors 26, 27 are latched together. See FIG. 3D. The inject cam surface 48 preferably include a small step, ridge, dimple, detent or groove 49 (each of these are considered equivalents for the purpose of this disclosure) which acts as a locking bump when detaching the connectors 26, 27 from one another. The small step 49 deters or prevents the connectors 26, 27 from being being pulled apart without applying a force on the lever 24. The cam surfaces 48, 50 have varying cam angles with respect to the protrusion 22 to control the mechanical advantage of the lever 24 along its stroke. In other words, the direction of the force applied by the cam surfaces 48, 50 on the protrusion 22 varies depending on whether more or less force is needed to inject or eject the connectors 26, 27. The cam surfaces 48, 50 are shaped or contoured to increase the mechanical advantage when more force is needed to inject or eject the connectors 26, 27. The cam surfaces 48, 50 can be continuously curved. Alternatively, the cam surfaces 45, 50 can have segments with different shapes or curves. As such, the mechanical advantage of the assemblies 20 is not constant. One way of increasing the mechanical advantage is to cause the protrusion 22 to travel a longer distance along one of the cam surfaces 48, 50 when higher force is required to inject or eject the connectors 26, 27.

The pivot 36 may be a rivot or nail-like extending through a passage 37 through the lever 24 and staked into the housing 30 of one of the connectors 26. Alternatively, the pivot 36 may be a shaft extending through a passage 37 through the lever 24 and the connector 26 and trapped from sliding out from the lever 24 or connector 26, such as, by spring clips. In any case, the lever 24 must be pivotable or rotatable with respect to the connector 26.

The grip 42 may extend around an edge of one end of the lever 24. Preferably, the grip 42 comprises a first finger indented portion 54, a second head portion 56 connected to the first portion 54, and a third substantially flat portion 58 connected to the second head portion 56. The third portion 58 is preferably substantially parallel to the first finger indented portion 54. The first, second and third portions 54, 56, 58 may be knurled to aid in gripping.

The distance between the pivot 36 and the grip 42 is longer than the distance between the pivot 36 and any point in the groove or slot 44 that can be occupied by the protrusion 22 such that use of the lever 24 provides a mechanical advantage in injecting and ejecting the connectors 26. Increasing the distance between the pivot 36 and the grip 42 with respect to the distance between the pivot 36 and such points in the groove or slot 44 increases the mechanical advantage. Further, increasing the stroke length (increasing the length of the camming surfaces and decreasing their slopes) increases the mechanical advantage.

The inject and eject cam lever assembly 20 may comprise one lever 24 and one protrusion 22 for each connector assembly 10. Preferably, however, the inject and eject cam lever assembly 20 comprises two of the levers 24 and two of the protrusions 22 for each connector assembly 10. In this case, a second protrusion 22 preferably extends from the second side 35 of the housing 30 with the first protrusion 22. The second side 35 of the housing 30 is distal to the first side 34 of the housing 30. A second lever 24 is pivotably mounted about a pivot 36 on a second side 39 of the housing 31 of the connector 27 without the protrusions 22. The second lever 24 has a grip 42 and a groove, slot, recess or pocket 44 for receiving the protrusion 22. The second groove or slot 44 has a mouth end 46, an inject cam surface 48, an eject cam surface 50 and a mated end 52. These inject cam surfaces 48 preferably include a small step, ridge, dimple, detent or groove 49 which acts as a locking bump when detaching the connectors 26, 27 from one another.

Figure 3A:
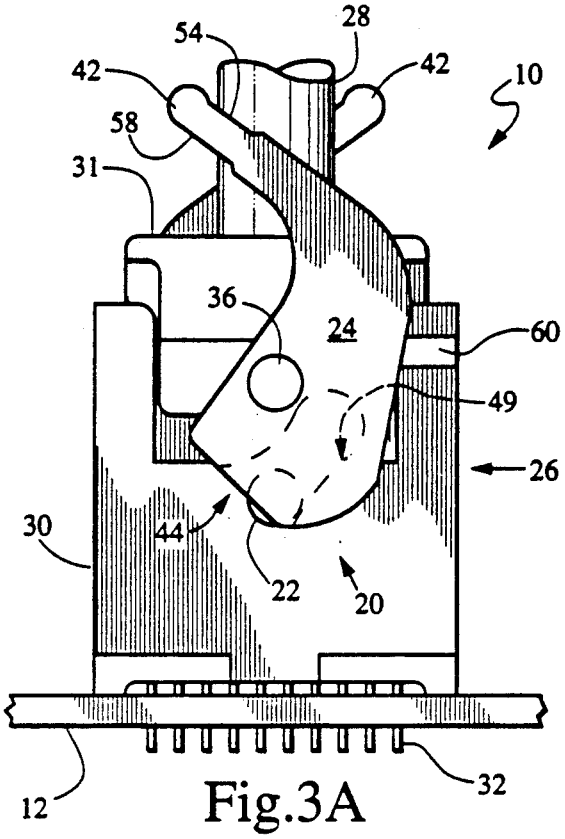
FIG. 3A is a schematic side view of a connector assembly with a first embodiment of a pair of inject and eject cam lever assemblies in a first position in accordance with the present invention.
Figure 3B:
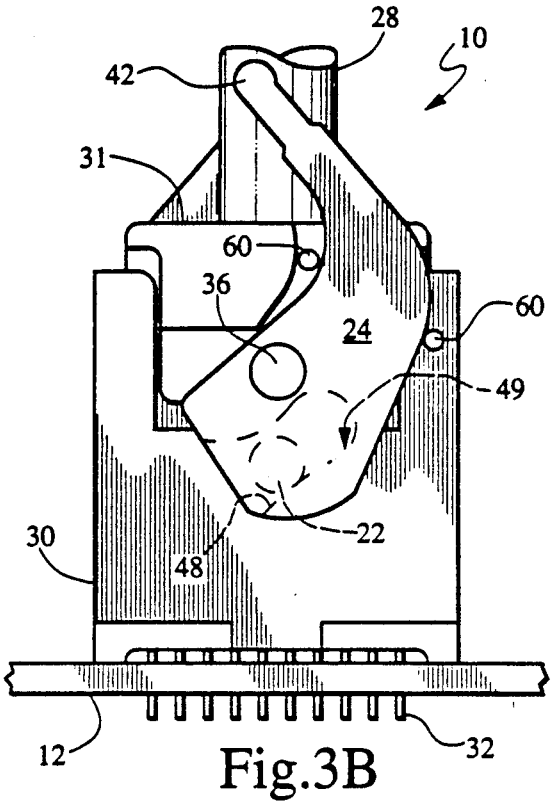
FIG. 3B is a schematic side view of the connector assembly of FIG. 3A with the pair of inject and eject cam lever assemblies in a second position in accordance with the present invention.

Referring to FIGS. 3A and 3B, one or more dimple, detent or raised portion 60 may optionally be on either of the housings 26, 27 (or the lever 24) to stop or retain the levers 24 in one or more positions.

FIG. 3A–3D illustrate the operation of the first embodiment of the connector assembly 10 of the present invention. In operation, the connectors 26, 27 can be injected to a fourth, mated and latched, position (illustrated in FIG. 3D) by first positioning the first connector 26 adjacent the second connector 27 substantially before the force is applied. Then the levers 24 are positioned such that one of the protrusions 22 is in a first position in each of the mouth ends 46 of the grooves or slots 44.

FIG. 3A is a schematic side view of the connector assembly 10 with the first embodiment of the pair of inject and eject cam lever assemblies 20 in the first or unmated position in accordance with the present invention. In this embodiment, the protrusions 22 are on the first housing 30 and the levers 24 are pivotably mounted on the second housing 31. Here, the pivot 36 is positioned between the grip 42 and the groove or slot 44. In the position illustrated in FIG. 3A, the first connector 26 is positioned adjacent the second connector 27 substantially before any force is necessary to connect the connectors 26, 27. Typically, in this first position the terminals 32 in the first connector 26 have just contacted the terminals (not depicted) in the second connector 27. In this view, the levers 24 have been pivoted or positioned such that the protrusions 22 are in a first position in the mouth ends 46 of the slots or grooves 44. In FIG. 3A, the inject and eject cam lever assemblies 20 are in position to begin facilitating insertion of the second connector 27 which is illustrated as a female connector or receptacle into the first connector 26 which is illustrated as a male connector, header or shroud assembly. The male connector 26 is also shown connected to the printed circuit or wiring board 12.

Figure 3C:
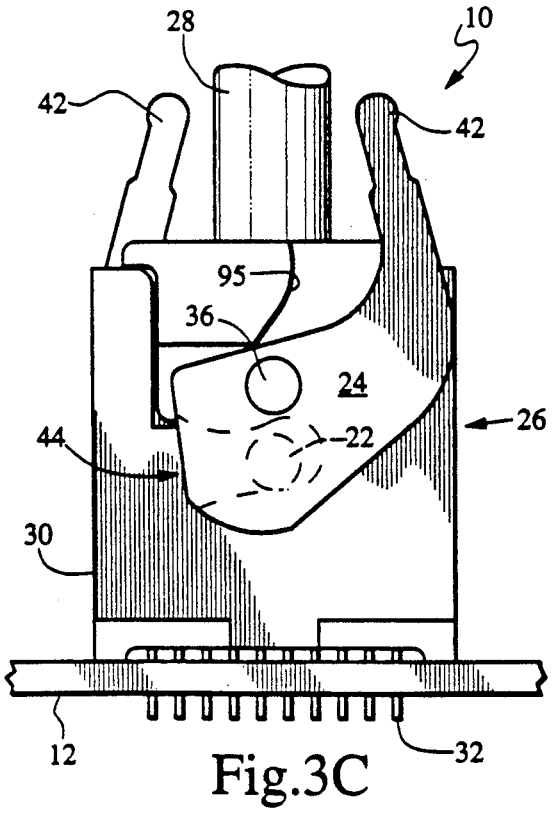
FIG. 3C is a schematic side view of the connector assembly of FIG. 3A with the pair of inject and eject cam lever assemblies in a third position in accordance with the present invention.
Figure 3D:
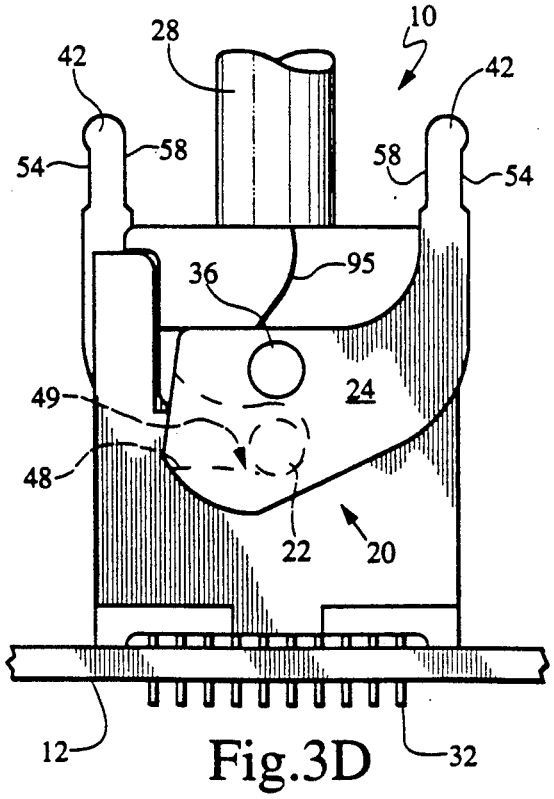
FIG. 3D is a schematic side view of the connector assembly of FIG. 3A with the pair of inject and eject cam lever assemblies in a fourth position in accordance with the present invention.

Then the grips 42 are squeezed, for instance, between a thumb and a pointing finger, initially generally towards one another and then forcing the grips 42 generally away from each other while camming the protrusion 22 against the inject cam surface 48. FIG. 3B is a schematic side view of the connector assembly 10 with the pair of inject and eject cam lever assemblies 20 in a second position intermediate the first position illustrated in FIG. 3A and the fourth, mated and latched, position illustrated in FIG. 3D. FIG. 3C is a schematic side view of the connector assembly 10 with the pair of inject and eject cam lever assemblies 20 in a third, mated and unlatched, position intermediate the second position illustrated in FIG. 3B and the mated position illustrated in FIG. 3D. In FIG. 3C, the protrusion is located on or just to the left of, but has not quite passed over, the small step, ridge, dimple, detent or groove 49 in the inject camming surface 48. FIG. 3D is a schematic side view of the connector assembly 10 with the pair of inject and eject cam lever assemblies 20 in the fourth or mated position in accordance with the present invention. In the mated position of this embodiment, the parallel portions 54, 58 of the grip 42 are oriented parallel to the insertion or ejection direction of the connectors 26, 27. This orientation of the parallel portions 54, 58 indicates that the connectors 26, 27 are locked or latched together.

Figure 4A:
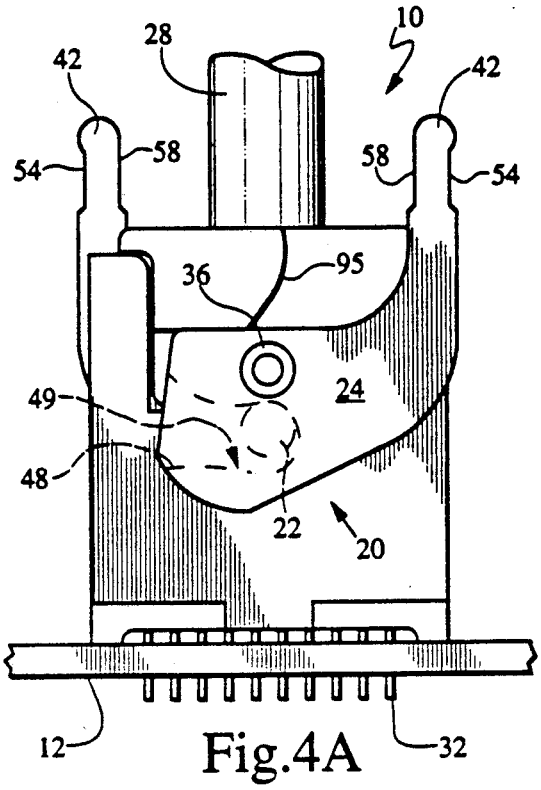
FIG. 4A is a schematic side view of the connector assembly of FIG. 3A with the pair of inject and eject cam lever assemblies in a fifth position in accordance with the present invention.
Figure 4B:
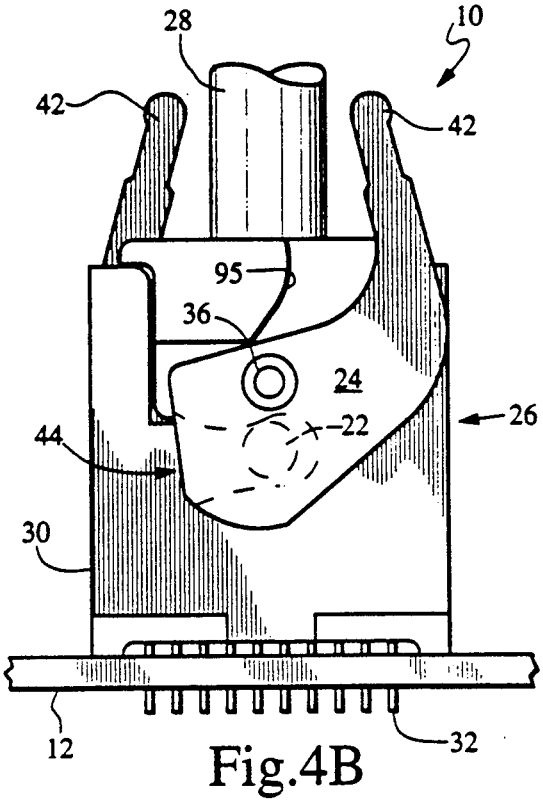
FIG. 4B is a schematic side view of the connector assembly of FIG. 3A with the pair of inject and eject cam lever assemblies in a sixth position in accordance with the present invention.
Figure 4C:
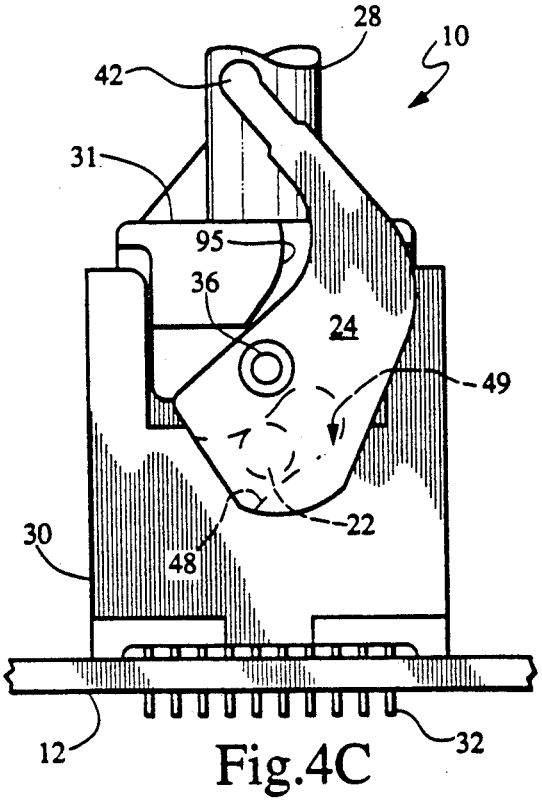
FIG. 4C is a schematic side view of the connector assembly of FIG. 3A with the pair of inject and eject cam lever assemblies in a seventh position in accordance with the present invention.
Figure 4D:
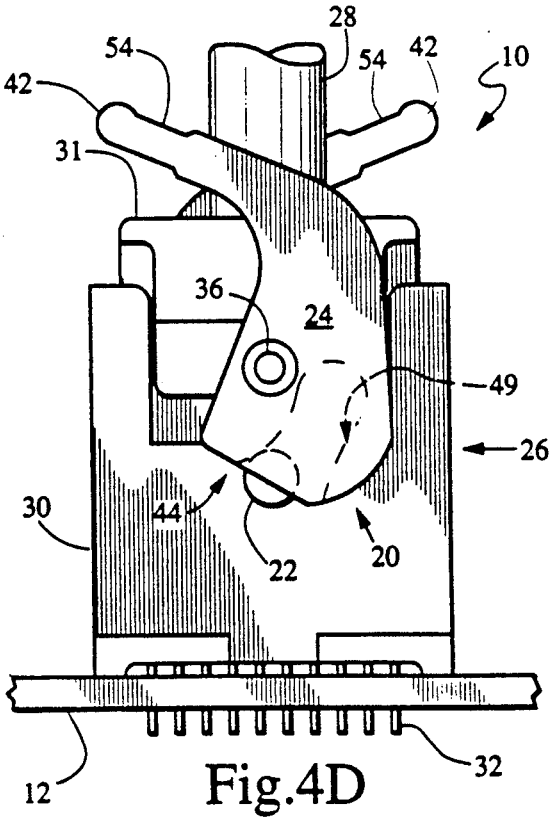
FIG. 4D is a schematic side view of the connector assembly of FIG. 3A with the pair of inject and eject cam lever assemblies in an eighth position in accordance with the present invention.

FIGS. 4A–4D illustrate the ejection process. FIG. 4A is a schematic side view of the connector assembly 10 of FIG. 3A with the pair of inject and eject cam lever assemblies 20 in a fifth position in accordance with the present invention. To eject the second connector 27 from the first connector 26, the grips 42 are squeezed initially generally towards one another. This moves the protrusion 22 from contacting the inject cam surface 48 side of the mated end 52 as depicted in FIG. 3D to contacting the eject cam surface 50 side of the mated end 52 as depicted in FIG. 4A. Then the grips 42 are forced generally towards one another camming the protrusion 22 against the eject cam surface 50 until the connectors 26, 27 are in a sixth, mated and unlatched, position illustrated in FIG. 4B. The grips 42 are forced generally towards one another camming the protrusion 22 against the eject cam surface 50 until the point where the levers 24 pass one another as illustrated in a seventh position in FIG. 4C. The seventh position can be where the terminals within the connectors 26, 27 become unmated. Then the grips are forced generally away from each other while still camming the protrusion 22 against the eject cam surface 50 until the connectors are in an eighth or unmated position as illustrated in FIG. 4D.

Figure 5:
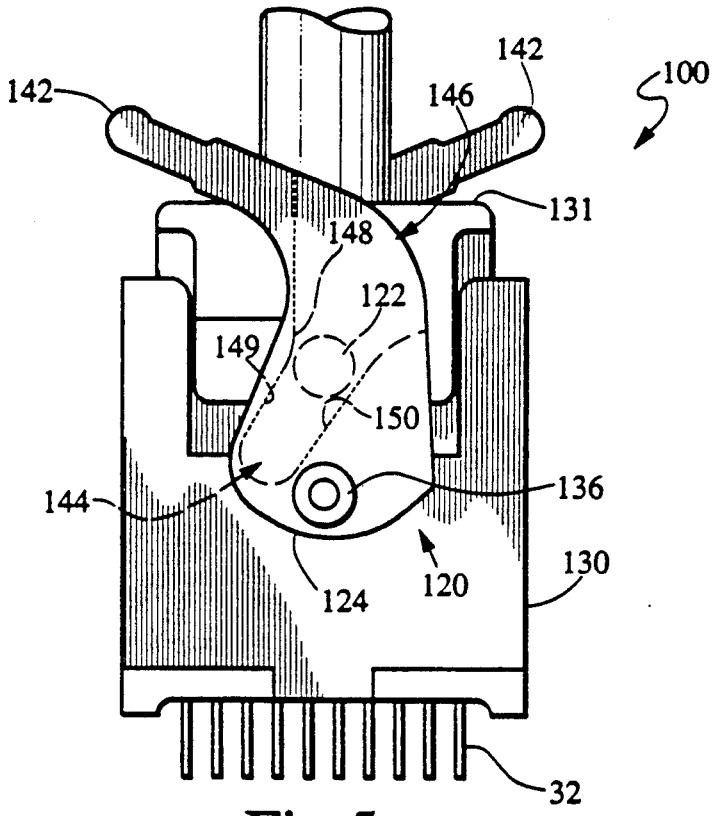
FIG. 5 is a schematic side view of an connector assembly with a second embodiment of a pair of inject and eject cam lever assemblies in accordance with the present invention.

FIG. 5 is a schematic side view of an connector assembly 100 with a second embodiment of a pair of inject and eject cam lever assemblies 120 in their unmated position in accordance with the present invention. In this embodiment, the protrusions 122 are on the second housing 131 and the levers 124 are pivotably mounted on the first housing 130. Here, the groove or slot 144 is positioned between the pivot 136 and the grip 142.

To insert the second housing 131 into the first housing 130, the grips 142 are squeezed initially generally towards one another. Then the grips 142 are forced generally away from each other while camming the protrusions 122 against the inject cam surfaces 148 until the protrusions 122 are in the latched position. Then to eject the second housing 131 from the second housing 132, the grips 142 are squeezed initially generally towards one another. Then the grips 142 are forced generally away from each other while camming the protrusions 122 against the eject cam surfaces 150 until the protrusions 122 are in the mouth end 146 of the groove 144. The inject cam surfaces 48 preferably include a small step, ridge, dimple, detent or groove 149, similar to element 49 in the first embodiment.

Referring again to FIG. 1, there is illustrated a printed circuit board (PCB) assembly 70. The PCB assembly comprises a printed circuit board 12 with a plurality of male pins 32 secured by an interference fit or soldering in plated through holes (not depicted) through the board 12. As is well known in the art, conductive paths (not depicted) may exist on the sides of the board 12 to and from ring shaped conductive pads around the holes and electrically connected to conductive material in the holes. The PCB assembly 70 further comprises a plurality of male housings, shells or shrouds 30 positioned around sets of the pins 32. The male housings, shells or shrouds 30 may have feet 72 for securing to the printed circuit board 12, such as, by rails 74. Each male housing, shell or shroud 30 combined with a set of the pins 32 can be referred to as a first connector 26. The PCB assembly 70 further comprises a plurality of receptacles or second connectors 27. Each of the receptacles 27 comprises a housing or shell 31 holding a plurality of female terminals (not depicted). The receptacles 27 illustrated in FIG. 1 are attached to ends of multiple conductor cables 28.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An inject and eject cam lever assembly for providing a mechanical advantage while forcing a first connector into a mated position with a second connector, the assembly comprising:

a first protrusion for extending from a first side of either the first connector or the second connector; and a first lever for pivotably mounting about a pivot on a first side of the connector without the protrusion, the lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from the mated position by positioning the first connector adjacent the second connector substantially before the force is applied, positioning the lever with the protrusion in the mouth end, applying a force on the grip in a first direction camming the protrusion against the inject cam surface until the connectors are in the mated position, and applying a force on the grip in a second direction camming the protrusion against the eject cam surface until the protrusion is substantially in the first position.

2. The inject and eject cam lever assembly of claim 1, wherein:

the groove or slot is positioned between the pivot and the grip.

3. The inject and eject cam lever assembly of claim 1, wherein:

the pivot is positioned between the grip and the groove or slot.

4. The inject and eject cam lever assembly of claim 1, wherein:

the inject cam surface has a small step, ridge, dimple, detent or groove which deters or prevents the connectors from being being pulled apart without applying a force on the lever.

5. The inject and eject cam lever assembly of claim 1, wherein:

the cam surfaces have at least one curved segment to increase the mechanical advantage when more force is needed to inject or eject the connectors.

6. The inject and eject cam lever assembly of claim 1, wherein:

the distance between the pivot and the grip is longer than the distance between the pivot and the protrusion when the protrusion is in the groove or slot such that use of the lever provides a mechanical advantage in injecting and ejecting the connectors.

7. The inject and eject cam lever assembly of claim 1, further comprising:

a second protrusion extending from a second side of the connector with the first protrusion, the second side of the connector distal to the first side of the connector; and a second lever pivotably mounted about a pivot on a second side of the connector without the protrusions, the second lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from the mated position by positioning the first connector adjacent the second connector substantially before the force is applied, positioning the levers such that one of the protrusions is in a first position in each of the mouth ends, squeezing the grips initially generally towards one another and then forcing the grips generally away from each other while camming the protrusion against the inject cam surface until the connectors are in the mated position, and then squeezing the grips initially generally towards one another and then forcing the grips generally away from each other while camming the protrusion against the eject cam surface until the protrusion is substantially in the first position.

8. The inject and eject cam lever assembly of claim 1, wherein:

the grip comprises a first finger indented portion, a second head portion connected to the first portion, and a third portion connected to the second head portion.

9. An electrical connector assembly comprising:

a first connector having a housing and a plurality of electrical contact elements;

a second connector having a housing and a plurality of electrical contact elements, the second connector adapted to mate with the first connector when a force is exerted to push or pull the connectors together;

a first protrusion extending from a first side of the housing of either the first connector or the second connector; and a first lever pivotably mounted about a pivot on a first side of the housing of the connector without the protrusion, the lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from a mated position by positioning the first connector adjacent the second connector substantially before the force is applied, positioning the lever with the protrusion in a first position in the mouth end, applying a force on the grip in a first direction camming the protrusion against the inject cam surface until the connectors are in the mated position, and applying a force on the grip in a second direction camming the protrusion against the eject cam surface until the protrusion is substantially in the first position.

10. The connector assembly of claim 9, wherein:

the groove or slot is positioned between the pivot and the grip.

11. The connector assembly of claim 9, wherein:

the pivot is positioned between the grip and the groove or slot.

12. The connector assembly of claim 9, wherein:

the inject cam surface has a small step, ridge, dimple, detent or groove which deters or prevents the connectors from being being pulled apart without applying a force on the lever.

13. The connector assembly of claim 9, wherein:

the cam surfaces have at least one curved segment to increase the mechanical advantage when more force is needed to inject or eject the connectors.

14. The connector assembly of claim 9, wherein:

the distance between the pivot and the grip is longer than the distance between the pivot and the protrusion when the protrusion is in the groove or slot such that use of the lever provides a mechanical advantage in injecting and ejecting the connectors.

15. The connector assembly of claim 9, further comprising:

a second protrusion extending from a second side of the housing with the first protrusion, the second side of the housing distal to the first side of the housing; and a second lever pivotably mounted about a pivot on a second side of the housing of the connector without the protrusions, the second lever having a grip and a groove or slot for receiving the protrusion, the groove or slot having a mouth end, an inject cam surface and an eject cam surface, the cam surfaces having varying cam angles to control the mechanical advantage of the lever along its stroke, such that the connectors can be injected to and ejected from a mated position by positioning the first connector adjacent the second connector substantially before the force is applied, positioning the levers such that one of the protrusions is in a first position in each of the mouth ends, squeezing the grips initially generally towards one another and then forcing the grips generally away from each other while camming the protrusion against the inject cam surface until the connectors are in the mated position, and then squeezing the grips initially generally towards one another and then forcing the grips generally away from each other while camming the protrusion against the eject cam surface until the protrusion is substantially in the first position.

16. The connector assembly of claim 9, wherein the first side of the housing connected to the lever includes:

a first surface for inserting in the mating connector;

a second surface with the first lever pivotably mounted about the pivot on the second surface;

a third surface, where the first, second and third surfaces are parallel or generally parallel to one another;

a first step separating the first and second surfaces; and a second step separating the second and third surfaces.

17. The connector assembly of claim 16, wherein the second step comprises:

a first surface portion; and a second surface portion, such that the first surface portion contacts or stops a first edge portion of the lever when the lever is in its latched and mated position and the second surface portion contacts or stops a second edge portion of the lever when the lever is in its unlatched and unmated position.

* * * * *